US005735144A

United States Patent [19]

Gabel

[11] Patent Number: 5,735,144

[45] Date of Patent: Apr. 7, 1998

[54] INTERCONNECTABLE RINGS

[76] Inventor: Elizabeth Man Gabel, Block 5, Site 2 Whampoa Garden 13th Floor, Flat E, Kowloon, Hong Kong

[21] Appl. No.: 602,585

[22] Filed: Feb. 16, 1996

[51] Int. Cl.[6] ..... A44C 9/00

[52] U.S. Cl. ..... 63/15.1; 63/15.3; 63/27; 63/29.1

[58] Field of Search ..... 63/15.1, 15.2, 63/15.3, 15.4, 27, 29.1, 31

[56] References Cited

U.S. PATENT DOCUMENTS 424,211 3/1890 Kaas et al. ..... 63/15.3

5,419,158 5/1995 Sandberg et al. ..... 63/15.1 X

FOREIGN PATENT DOCUMENTS 2650489 2/1991 France ..... 63/15.4

*Primary Examiner*—Kien T. Nguyen

*Attorney, Agent, or Firm*—Evanns & Walsh

[57] ABSTRACT

A ring member connectable with at least one other ring member comprises a shank and a connector on the shank for connecting to a connector on at least one other ring, the latter connector being on the shank of the second ring.

43 Claims, 2 Drawing Sheets

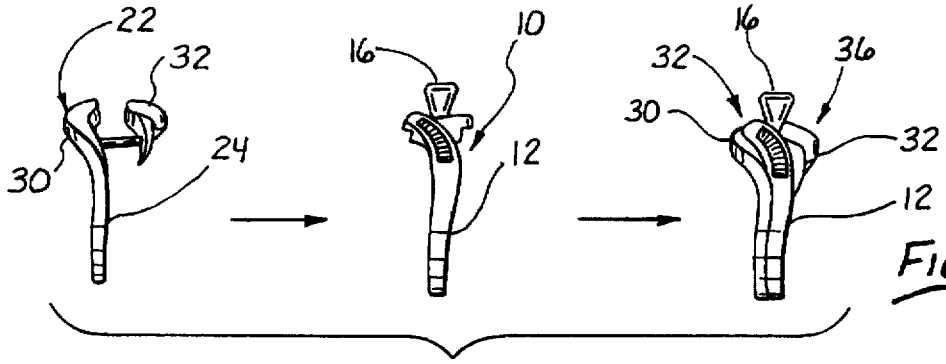
Fig. 1
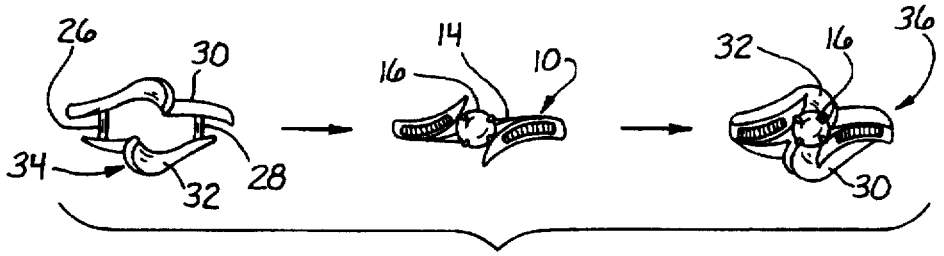
Fig. 2
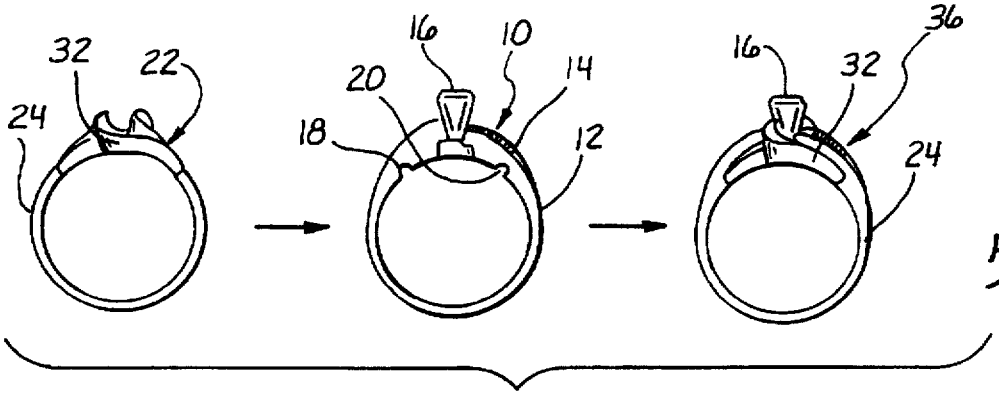
Fig. 3
Fig. 4
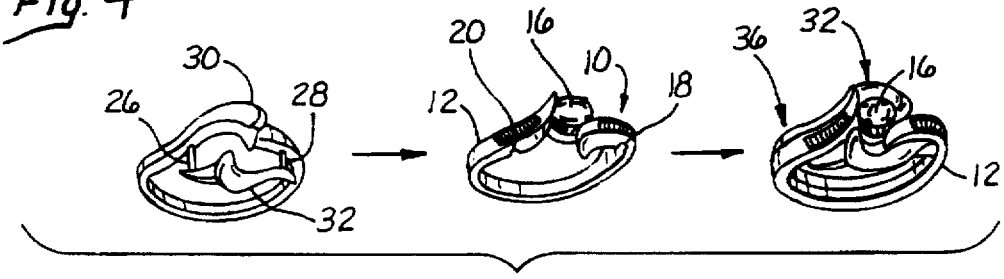

INTERCONNECTABLE RINGS

BACKGROUND OF THE INVENTION

1. Field of the Invention

The invention pertains to rings for use as jewelry.

2. History of the Prior Art

The present invention is depicted and described in connection with engagement rings and wedding rings; thus, the prior art is described in this context.

The gift of a ring to mark an engagement to be married is a tradition of long standing. Similarly, a wedding band or ring marks the entry into marriage. Frequently, women prefer to wear both engagement ring and wedding ring together. This practice has presented a number of problems. Among these are often unesthetic appearance of two separately-designed, dissimilar jewelry items, as well as the inconvenience of putting on and removing two separate pieces. On occasion, such rings have been secured together as by soldering, thus eliminating the separateness of the pieces while leaving unaddressed the esthetic issues.

Consequently,some existing rings include an engagement ring together with a wedding ring configured to receive the engagement ring and having two shanks enclosing the engagement ring whose shank is concentric with those of the wedding ring, the wedding ring providing an opening to accommodate the stone on the engagement ring. These devices, also, have drawbacks. They frequently present an impression to many of cumbersomeness and heaviness primarily due to the presence of two shanks on the wedding band together with a separate shank for the engagement ring. In addition, manipulation of the separate rings presents the risk of dropping or misplacing one or both of the rings.

Therefore, there has been a felt but unfulfilled need for rings having a capability of being worn together without sacrifice of convenience and esthetic quality.

SUMMARY OF THE INVENTION

A ring member connectable with at least one other ring member comprises a shank and connector means on the shank for connecting to connector means on at least one other ring, the latter connector means being on the shank of the second ring.

BRIEF DESCRIPTION OF THE DRAWINGS

FIG. 1 is a side view of two ring members in accordance with the invention depicted separately and connected;

FIG. 2 is a front view of the rings depicted in FIG. 1;

FIG. 3 is a bottom view of the rings depicted in FIG. 1.

FIG. 4 is a front view of the rings depicted in FIG. 1, somewhat upwardly rotated;

DESCRIPTION OF A PREFERRED EMBODIMENT

Figure 5:
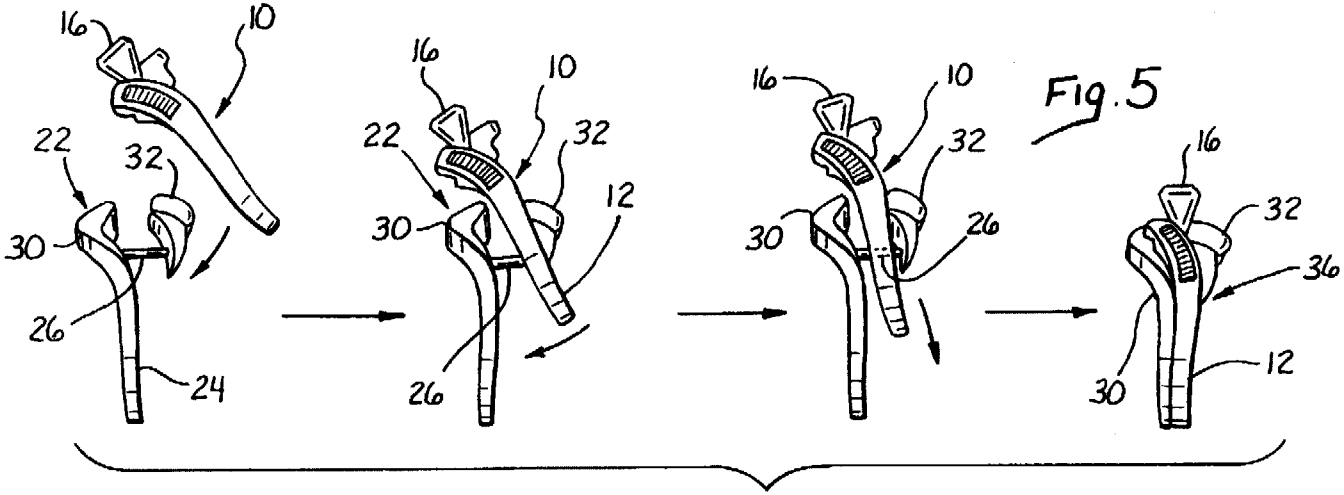
FIG. 5 is a side view depicting connecting ring members in accordance with the invention.

As depicted in the drawings, a ring member 10 includes a shank 12. The depicted embodiment includes a retainer portion 14 of the shank 12, together with a stone 16 therein; these are depicted and described for particularity, and in other applications of the invention may be modified or absent.

Defined in shank 12 are connector means in the form of cutouts 18, 20 The particular form, number, and placement of cutouts 18, 20 is as depicted herein for specificity and may differ in particular applications in accordance with the invention.

Figure 6:
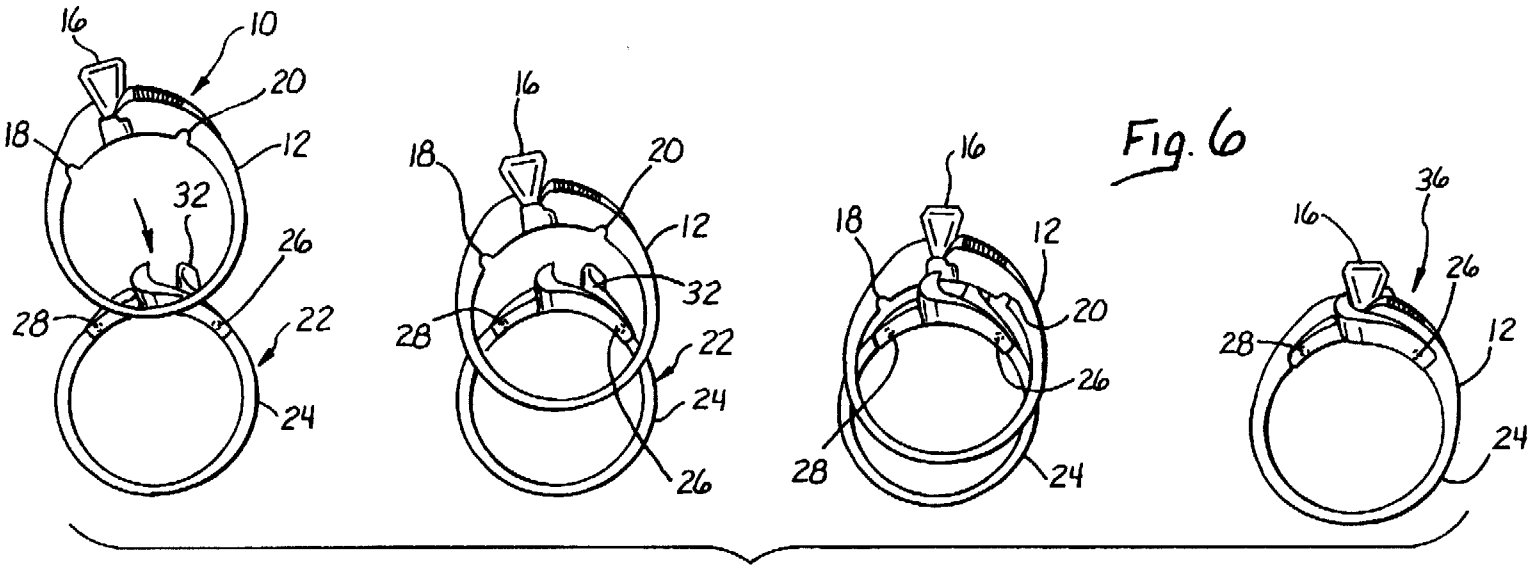
FIG. 6 is a bottom view of the ring members depicted in FIG. 5.

As depicted in FIGS. 1–6, inclusive, a second ring member 22 includes a shank 24. Positioned on shank 24 are connector means in the form of a pair of pins 26, 28. As with connector means 18, 20, the particular form, number and placement of connector means 18, 20 may vary in accordance with the invention from those shown in the depicted embodiment.

An anterior portion 30 of shank 24, together with pins 26, 28 and a closure member 32, form a cage 34 (in this context, "anterior" refers to the portion of the ring which would normally face outwardly while the ring is being worn).

As depicted in the drawings, member 10 and member 22 are connectable with one another to form an apparent single ring 36. In the connected condition, pins 26, 28 act as male connectors coupling to female connectors or receptacles 18, 20, and cage 32 encloses stone 16 contributing to a unified, integral appearance.

To connect ring member 10 with ring member 22, the anterior portion of the latter is moved through the area circumscribed by shank 12 of member 10. This motion is continued until pins 26, 28 (shown in phantom in FIG. 6) nest in receptacles 18, 20, shanks 12,24 being configured to conform to one another to present an impression of unity. In this arrangement, the connected rings may be conveniently placed on the wearer's finger, where the connected rings convey the impression of a single, harmoniously-designed whole. Because of the connection between the ring members 10, 22, there can be no slippage between the connected members thus reducing risk of loss and improving comfort. In addition when the rings are removed from the finger, simply gripping the connected rings with the thumb and index finger between the cage 32 and the shank 24 substantially 180 degrees apart prevents detachment of the rings facilitating storage and minimizing risk of loss through detachment and dropping of one or both ring members.

Therefore, in accordance with the invention a ring set is provided which combines convenience, esthetic quality and minimal risk of loss of one or both components.

Though a particular embodiment of the invention has been described and depicted hereinabove, the invention is defined by the appended claims interpreted in light of the specification and drawings.

What is claimed is:

1. A ring member connectable with at least one other ring member having a shank comprising:

(1) a shank;

(2) connector means on said shank, said connector means being engageable with second connector means connected with the shank on said at least one other ring member to connect with the first mentioned connector means thereby connecting said first-mentioned ring member to said at least one other ring member.

2. The invention as set forth in claim 1 wherein said first-mentioned ring member further includes at least one cage member for at least partially enclosing a portion of said at least one other ring member.

3. The invention as set forth in claim 2 wherein at least a portion of said cage member of said first-mentioned ring member is on said first-mentioned connector means.

4. The invention as set forth in claim 3 wherein said cage member includes at least a portion which is ornamental.

5. The invention as set forth in claim 3 wherein said first-mentioned connector means comprises at least one male connector member.

6. The invention as set forth in claim 1 wherein said first-mentioned connector means comprises at least one receptacle defined in said shank for receiving said second-mentioned connector means.

7. The invention as set forth in claim 1 wherein said second-mentioned connector means comprises at least one male connector member mounted on said second-mentioned shank member and wherein said first-mentioned connector means is configured to receive said at least one male connector member.

8. The invention as set forth in claim 7 wherein said at least one male connector member extends substantially perpendicular to said second-mentioned shank member.

9. The invention as set forth in claim 1 wherein said shank of said first-mentioned ring member and said shank of said second-mentioned ring member are configured so that said second-mentioned ring member is movable through space circumscribed by said shank of said first-mentioned ring member to connect said connector means of said first-mentioned ring member with second connector means of said second-mentioned ring member.

10. The invention as set forth in claim 1 wherein said first-mentioned connector means comprises at least one female connector for receiving said second-mentioned connector means.

11. The invention as set forth in claim 1 wherein said first-mentioned connector means comprises at least one female connector at least partially on the inside of said first-mentioned ring member.

12. The invention as set forth in claim 1 wherein said first-mentioned connector means comprises at least one receptacle at least partially on the inside of said first-mentioned ring member for receiving said second-mentioned connector means.

13. The invention as set forth in claim 1 wherein said first-mentioned connector means comprises at least one cutout at least partially on the inside of said shank for receiving said second-mentioned connector means.

14. The invention as set forth in claim 1 wherein said shank of said first-mentioned ring member defines a space for accommodating a member of a wearer of said ring member and for receiving at least a portion of said second-mentioned ring member upon connection of said first-mentioned connector means and said second-mentioned connector means one another.

15. The invention as set forth in claim 1 wherein said first-mentioned connector means comprises at least one male connector member.

16. The invention as set forth in claim 1 wherein said first-mentioned connector means comprises at least one pair of male connector members.

17. The invention as set forth in claim 1 wherein said first-mentioned connector means comprises at least one male connector member on the outside of said shank of said first-mentioned ring member.

18. Interconnectable rings comprising:

(1) at least one ring member including a shank and further including first connector means connected to said shank;

(2) at least one ring member other than said first-mentioned ring member including a shank and further including second connector means connectable to said first connector means to connect said first-mentioned ring member and said second-mentioned ring member and connected to said second-mentioned shank.

19. The invention as set forth in claim 18 wherein said first connector means on said first-mentioned ring member comprises at least one female connector on said shank.

20. The invention as set forth in claim 18 wherein said second-mentioned ring member includes a cage member configured to at least partially enclose at least a portion of said first-mentioned ring member when said first-mentioned ring member and said second-mentioned ring member are connected.

21. The invention as set forth in claim 18 wherein said first-mentioned ring member includes means for retaining a stone.

22. The invention as set forth in claim 18 wherein said first connector means comprises at least one female connector.

23. The invention as set forth in claim 18 wherein said first connector means comprises at least one female connector on said shank of said first-mentioned ring member.

24. The invention as set forth in claim 18 wherein said first connector means comprises at least one female connector at least partially on the inside of first-mentioned ring member.

25. The invention as set forth in claim 18 wherein said first connector means comprises at least one female connector at least partially on the inside of said shank of said first-mentioned ring member.

26. The invention as set forth in claim 18 wherein said first connector means comprises at least one receptacle.

27. The invention as set forth in claim 18 wherein said first connector means comprises at least one pair of receptacles.

28. The invention as set forth in claim 18 wherein said first connector means comprises at least one receptacle at least partially on the inside of said first-mentioned ring member.

29. The invention as set forth in claim 18 wherein said first connector means comprises at least one receptacle at least partially on the inside of said shank of said first ring member.

30. The invention as set forth in claim 18 wherein said first connector means comprises at least one cutout.

31. The invention as set forth in claim 18 wherein said first connector means comprises at least one pair of cutouts.

32. The invention as set forth in claim 18 wherein said first connector means comprises at least one cutout at least partially on the inside of said ring member.

33. The invention as set forth in claim 18 wherein said first connector means comprises at least one cutout at least partially on the inside of said shank of said first ring member.

34. The invention as set forth in claim 18 wherein said second connector means comprises at least one male connector member.

35. The invention as set forth in claim 18 wherein said second connector means comprises at least one male connector member on said shank of said second-mentioned ring member.

36. The invention as set forth in claim 18 wherein said shank of said first-mentioned ring member and said shank of second-mentioned ring member are configured such that said second-mentioned ring member is movable through space defined by said shank of said first-mentioned ring member to connect said first connector means with said second connector means, thereby connecting said first ring member to said second-mentioned ring member.

37. The invention as set forth in claim 18 wherein said shank of said first-mentioned ring member defines a space for accommodating a member of a wearer of said ring member and wherein at least a portion of said second-mentioned ring member is disposed in at least a portion of said space defined by said shank of said first-mentioned ring member upon connection of said first connector means and said second connector means.

38. The invention as set forth in claim 18 wherein said second connector means comprises at least one male connector member on the outside of said second-mentioned ring member.

39. The invention as set forth in claim 18 wherein said second connector means comprises at least one male connector member disposed substantially perpendicular to said second-mentioned ring member.

40. Interconnectable rings comprising:

(1) at least one ring member including a shank and further including first connector means on said shank; and (2) at least one ring member other than said first-mentioned ring member including a shank and further including second connector means connectable to said first connector means on said shank, said second connector means on said ring member comprising at least one male connector on said shank.

41. The invention as set forth in claim 40 wherein said first connector means comprises at least one female connector.

42. The invention as set forth in claim 40 wherein said first connector means comprises at least one female connector comprising at least two cutouts.

43. Interconnectable rings comprising:

(1) at least one ring member including a shank first connector means on said shank and means for retaining a stone; and (2) at least one ring member other than said first-mentioned ring member including a shank and further including second connector means connectable to said first connector means on said shank, said second connector means on said second-mentioned ring member comprising at least one male connector member, said second-mentioned ring member including a cage member configured to at least partially enclose at least a portion of said first-mentioned ring member when said first-mentioned ring member and said second-mentioned ring member are connected said at least one male connector member comprising a portion of said cage member said cage member being configured to enclose said stone.

* * * * *